US007607372B2

(12) United States Patent
Wu

(10) Patent No.: US 7,607,372 B2
(45) Date of Patent: Oct. 27, 2009

(54) METHOD FOR MAKING A WRENCH

(75) Inventor: Arthur Wu, Taichung County (TW)

(73) Assignee: Proxene Tools Co., Ltd., Taichung (TW)

( * ) Notice: Subject to any disclaimer, the term of this patent is extended or adjusted under 35 U.S.C. 154(b) by 0 days.

(21) Appl. No.: 11/798,953

(22) Filed: May 16, 2007

(65) Prior Publication Data

US 2008/0282848 A1 Nov. 20, 2008

(51) Int. Cl.
*B21K 5/16* (2006.01)

(52) U.S. Cl. ..... 76/114

(58) Field of Classification Search ..... 76/114; 81/155, 165, 170; D8/22
See application file for complete search history.

(56) References Cited

U.S. PATENT DOCUMENTS

| | | | | | |
|---|---|---|---|---|---|
| 56,602 | A * | 7/1866 | Pell | 76/114 |
| 458,797 | A * | 9/1891 | Shaw | 76/114 |
| 1,118,073 | A * | 11/1914 | Thomson | 76/114 |
| 1,314,044 | A * | 8/1919 | Buker | 81/185 |
| 1,395,222 | A * | 10/1921 | Coes | 76/114 |
| 1,502,192 | A * | 7/1924 | Helwig | 76/114 |
| 1,656,343 | A * | 1/1928 | Becklin | 76/114 |
| 2,112,840 | A * | 4/1938 | Haist | 76/114 |
| 2,293,866 | A * | 8/1942 | Talch | 76/114 |
| 2,511,912 | A * | 6/1950 | Georse | 76/114 |
| 2,572,492 | A * | 10/1951 | Kempf | 76/114 |
| 2,720,799 | A * | 10/1955 | Pfost | 76/114 |
| 2,909,954 | A * | 10/1959 | Rhoads | 81/186 |
| 3,742,788 | A * | 7/1973 | Priest | 81/61 |
| 4,123,953 | A * | 11/1978 | Corbacho, Jr. | 76/114 |
| 5,062,328 | A * | 11/1991 | Demurger | 81/186 |
| 5,172,614 | A * | 12/1992 | Monnet et al. | 81/177.1 |
| 5,626,061 | A * | 5/1997 | Whitley | 76/114 |
| 6,089,130 | A * | 7/2000 | Wu | 81/170 |
| 6,470,773 | B1 * | 10/2002 | Wu | 81/165 |
| 6,789,451 | B1 * | 9/2004 | Wu | 81/157 |
| 6,834,566 | B1 * | 12/2004 | Hsien | 76/114 |
| 6,848,343 | B2 * | 2/2005 | Wu | 81/170 |
| 6,851,338 | B2 * | 2/2005 | Wu | 81/170 |
| 6,966,242 | B2 * | 11/2005 | Picone | 81/165 |
| 7,117,767 | B1 * | 10/2006 | Kiat | 81/119 |
| D547,149 | S * | 7/2007 | Wu | D8/22 |
| 7,281,453 | B2 * | 10/2007 | Wu | 81/142 |
| 7,334,507 | B2 * | 2/2008 | Wu | 81/176.15 |

(Continued)

FOREIGN PATENT DOCUMENTS

EP 1225009 A1 * 7/2002

(Continued)

*Primary Examiner*—Jason Daniel Prone
(74) *Attorney, Agent, or Firm*—Banger Shia

(57) ABSTRACT

A method for making a wrench includes a step of making a mediate member, a movable jaw and an adjusting member, a step of applying heat treatment to the mediate member, the movable jaw and the adjusting member, a step of cleaning respective surfaces of the mediate member, the movable jaw and the adjusting member, and coating a anti-rusting layer on the mediate member, the movable jaw and the adjusting member, and a step of combination to put the mediate member in a mold and making a body by way of injection to integrally connect the mediate member to a head of the main body, the movable jaw and the adjusting member are installed to the body.

8 Claims, 5 Drawing Sheets

U.S. PATENT DOCUMENTS

| | | | | |
|---|---|---|---|---|
| 2003/0029262 | A1* | 2/2003 | Wu | 74/425 |
| 2003/0154830 | A1* | 8/2003 | Wu | 81/186 |
| 2003/0226621 | A1* | 12/2003 | Maeda et al. | 148/243 |
| 2004/0177727 | A1* | 9/2004 | Wu | 81/157 |
| 2004/0177733 | A1* | 9/2004 | Peters | 81/490 |
| 2006/0185476 | A1* | 8/2006 | Lin | 76/114 |
| 2008/0245196 | A1* | 10/2008 | Wu | 81/165 |
| 2008/0257121 | A1* | 10/2008 | Wu | 81/155 |
| 2008/0282849 | A1* | 11/2008 | Wu | 81/165 |
| 2008/0314208 | A1* | 12/2008 | Wu | 81/165 |
| 2009/0042484 | A1* | 2/2009 | Wu | 76/114 |
| 2009/0120246 | A1* | 5/2009 | Wu | 81/179 |

FOREIGN PATENT DOCUMENTS

| | | | | |
|---|---|---|---|---|
| EP | 1810786 | A2 | * | 7/2007 |
| FR | 2594063 | A1 | * | 8/1987 |
| FR | 2823462 | A3 | * | 10/2002 |
| GB | 2018179 | A | * | 10/1979 |
| JP | 57138548 | A | * | 8/1982 |
| JP | 57201136 | A | * | 12/1982 |
| WO | WO 8002668 | A1 | * | 12/1980 |

* cited by examiner

METHOD FOR MAKING A WRENCH

BACKGROUND OF THE INVENTION (1) Field of the Invention

The present invention relates to an adjustable wrench and a method for making the wrench, wherein the method involves less number of processes.

(2) Description of the Prior Art

A conventional wrench includes multiple parts and some parts include complicated shapes which require many steps of treatments to finish. The conventional wrench generally is made of metallic material such as alloy and the necessary processes for making the wrench are hot gorging, annealing, sand spraying, machining, heat treatment, grinding and polishing. Therefore, the time required to finish a wrench is too long to keep its price competition in market.

The present invention intends to provide a wrench and a method for making the wrench wherein the handle is made of a combination of metallic and nonmetallic material, the movable jaw is made of metallic material and is connected with the handle by way of plastic injection. The method includes less number of processes and the wrench is lightweight.

SUMMARY OF THE INVENTION

The present invention relates to a method for making a wrench and the method comprises the following steps:

a step of formation: making a mediate member, a movable jaw and an adjusting member;

a step of heat treatment: applying heat treatment to the mediate member, the movable jaw and the adjusting member;

a step of surface treatment: cleaning respective surfaces of the mediate member, the movable jaw and the adjusting member, coating a anti-rusting layer on the mediate member, the movable jaw and the adjusting member, and a step of combination: putting the mediate member in a mold and making a body by way of injection, a material for making the body being different from material of the mediate member, the body including a handle and a head, the mediate member integrally combined with the head, the movable jaw and the adjusting member being installed to the body.

The primary object of the present invention is to provide a method for making a wrench at low cost within a short period of time.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENTS

Figure 1:
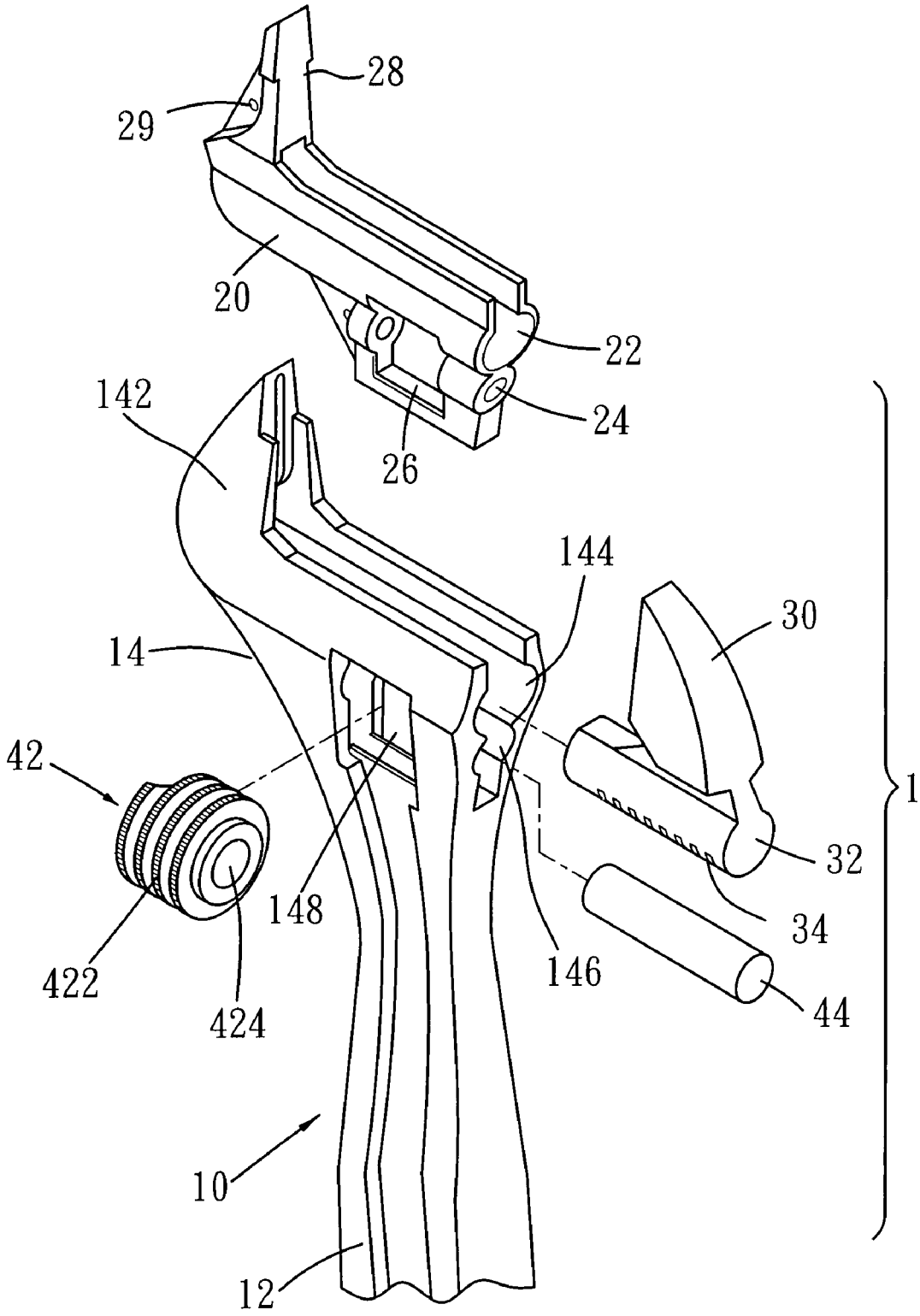
FIG. 1 is an exploded view to show the wrench of the present invention.
Figure 2:
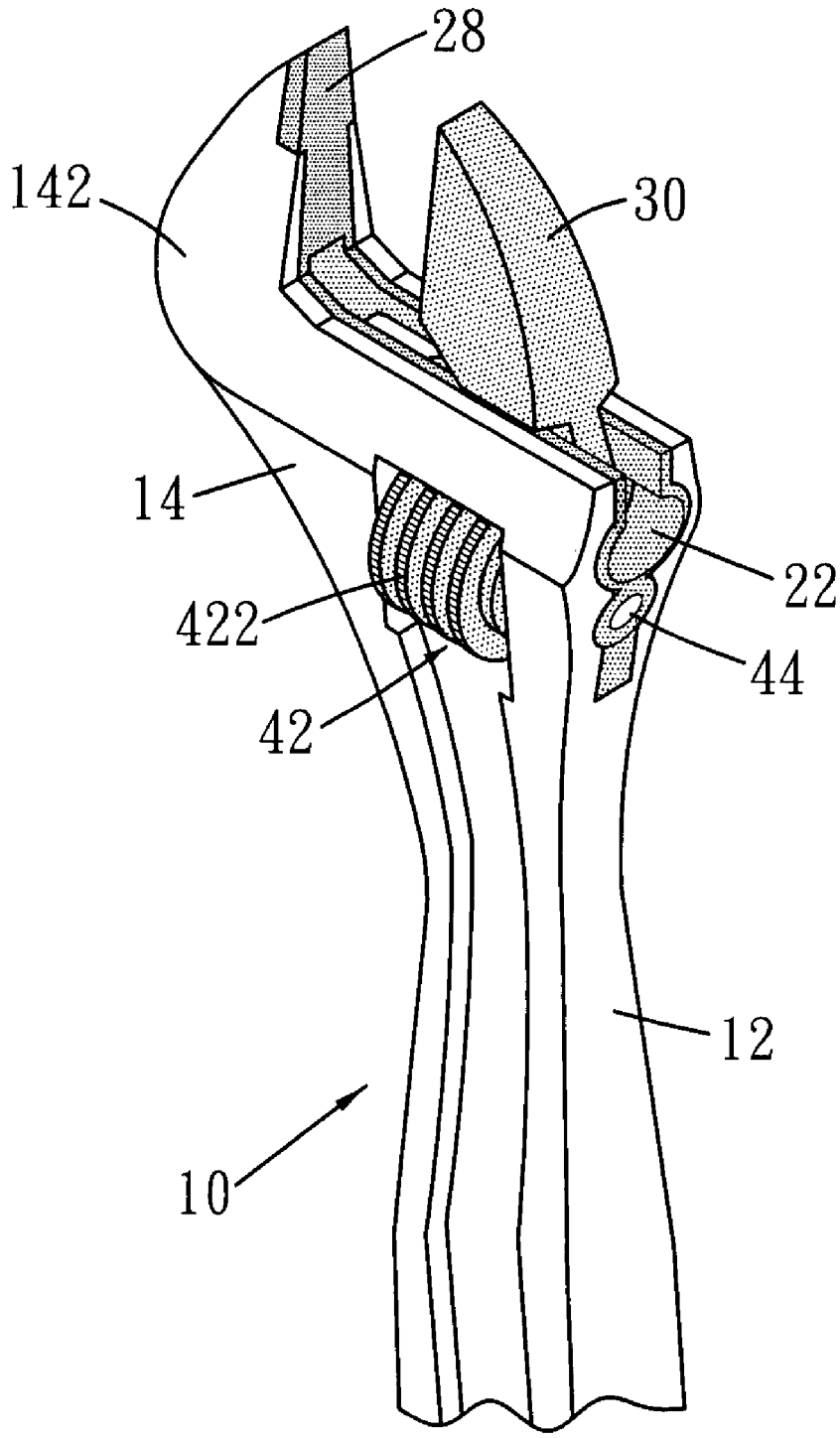
FIG. 2 is a perspective view to show the wrench of the present invention.
Figure 3:
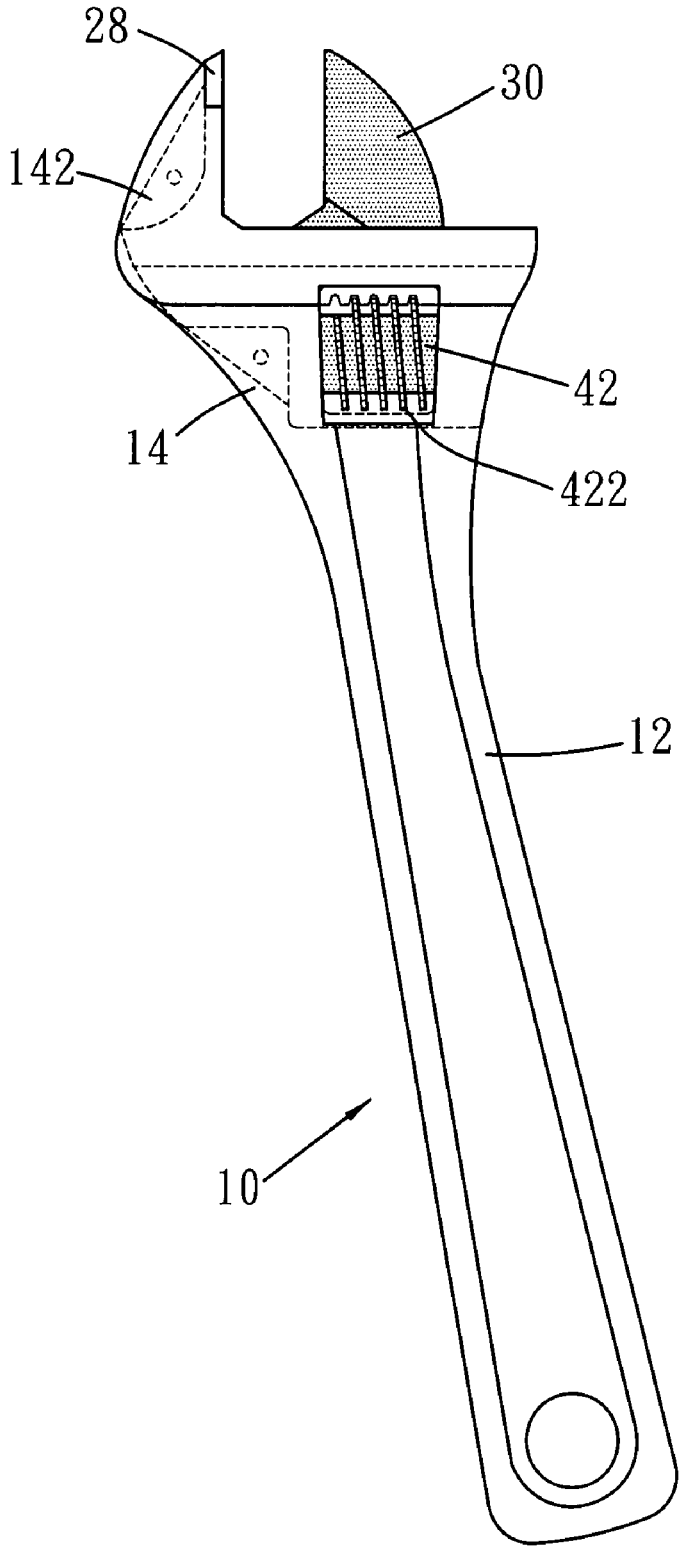
FIG. 3 is a side view of the wrench of the present invention.

Referring to FIGS. 1 to 3, the wrench 1 of the present invention comprises a main body 10 which is made of nonmetallic material such as carbon fibers or glass fibers, or non-iron material such as aluminum alloy or zinc alloy. The main body 10 includes a handle 12 and a head 14 which includes a fixed jaw 142 extending from an end of a top thereof and a groove 144 and a passage 146 are defined transversely in the head 14. The passage 146 is located parallel to the groove 144 and communicates with the groove 144. A through hole 148 is defined through the head 14 and communicates with the groove 144 and the passage 146.

A mediate member 20 made of metal and is integrally connected with the head 14 by way of injection. The mediate member 20 includes a protrusion 28, a tubular portion 22 and a frame 26 with an opening. Two through holes 24 are defined in tow sidewalls of the frame 26. The protrusion 28 is inserted in the hollow fixed jaw 142 from an open side and a pan of the mediate member 20 is located outside of the open side. The tubular portion 22 includes an axial open top and is engaged with the groove 144. The frame 26 is engaged with the through hole 148.

A movable jaw 30 made of metal and includes a sliding rod 32 which is slidably received in the tubular portion 22. A plurality of teeth 34 are defined in an underside of the sliding rod 32.

An adjusting member is made of metal and engaged with the opening of the frame 26. The adjusting member is a metal worm member 42 which includes a passage 424 defied axially therethrough and a shaft 44 extends through the two trough holes 24 in the mediate member 20 and the passage 424, so that the worm member 42 is engaged with the teeth 34 of the sliding rod 32 by teeth 422 defined in an outer periphery thereof. The user simply rotates the worm member 42 to drive the movable jaw 30 along the groove 144.

The mediate member 20 includes a hole 29 defined therethrough so that when the material of the main body 10 is ejected in a mold, the material is filled in the hole 29 to firmly connected the mediate member 20 with the fixed jaw 142. The main body 10 can also be connected to the mediate member 20 by rivets or any known method.

Figure 5:
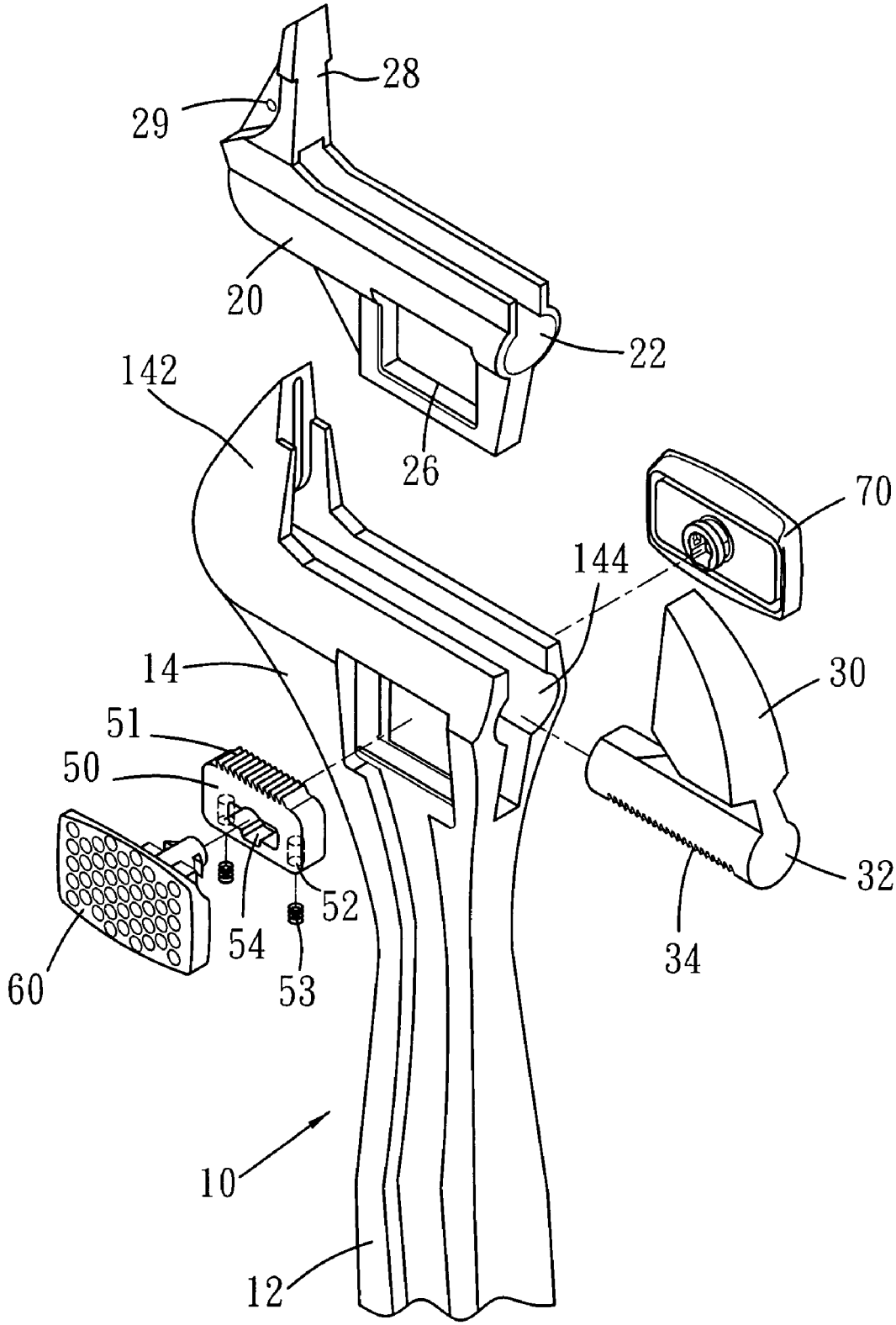
FIG. 5 shows another embodiment of the wrench of the present invention.

FIG. 5 shows another embodiment of the wrench, wherein the through holes 24 in the frame 26 of the first embodiment are omitted and the adjusting member includes a restriction member 50, a male part 60 and a female part 70. The restriction member 50 is sandwiched between the male part 60 and the female part 70. The restriction member 50 is engaged with the opening of the frame 26 and includes teeth 51 defined in a top thereof. Two recesses 52 are defined in an underside of the restriction member 50 and two springs 53 are inserted in the two recesses 52 so that the restriction member 50 is pushed upward and the teeth 51 are engaged with the teeth 34 on the sliding rod 32. A central hole 54 is defined through the restriction member 50 so that the male part 60 and the female part 70 each have a part inserted through the central hole 54 to connected to each other. When the user pulls the restriction member 50 downward to disengage the teeth 51 from the teeth 34, the fixed jaw 30 can be moved.

Figure 4:
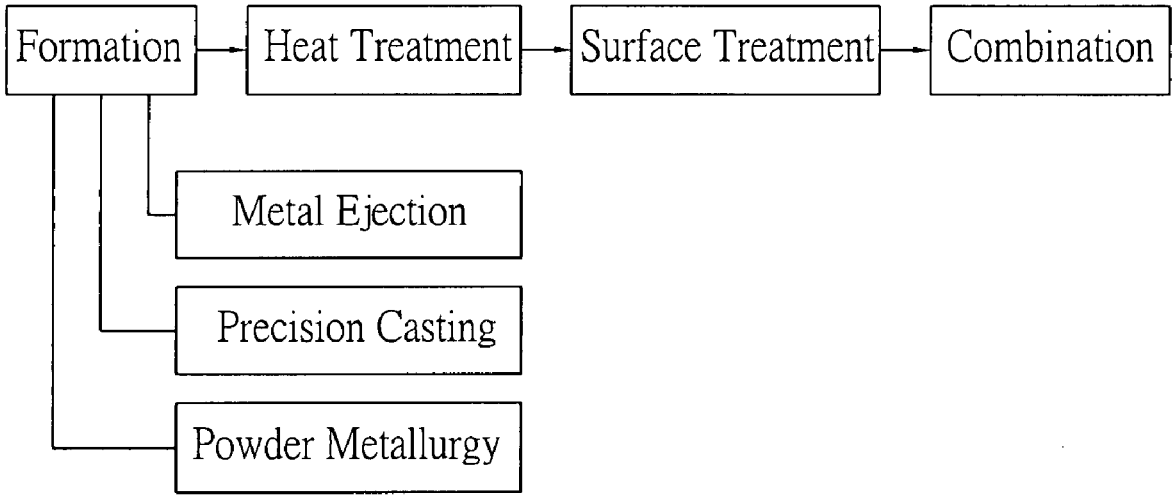
FIG. 4 discloses the steps of the method of the present invention.

FIG. 4 shows a method for making the wrench 1 and the method comprises the following steps:

a step of formation: making a mediate member 20, a movable jaw 30 and an adjusting member;

a step of heat treatment: applying heat treatment to the mediate member 20, the movable jaw 30 and the adjusting member;

a step of surface treatment: cleaning respective surfaces of the mediate member 20, the movable jaw 30 and the adjusting member, coating an anti-rusting layer on the mediate member 20, the movable jaw 30 and the adjusting member, and a step of combination: putting the mediate member 20 in a mold and making a body 10 by way of injection, a material for making the body 10 being different from material of the mediate member 20, the body 10 including a handle 12 and a head 14, the mediate member 20 integrally combined with the head 14, the movable jaw 30 and the adjusting member being installed to the body 10.

The mediate member 20 can be made by way of powder metallurgy, precision casting or metal ejection to meet different requirements.

While we have shown and described the embodiment in accordance with the present invention, it should be clear to those skilled in the art that further embodiments may be made without departing from the scope of the present invention.

What is claimed is:

1. A method for making a wrench, comprising:

a step of formation: making a mediate member, a movable jaw and an adjusting member, which are made of metal;

a step of heat treatment: applying heat treatment to the mediate member, the movable jaw and the adjusting member to enhance rigidity;

a step of surface treatment: cleaning respective surfaces of the mediate member, the movable jaw and the adjusting member, coating an anti-rusting layer on the mediate member, the movable jaw and the adjusting member, and a step of combination: putting the mediate member in a mold and making a body by way of injection, wherein a material making up the body is selected from nonmetallic material or non-iron material, the body including a handle and a head, the mediate member integrally combined with the head of the body, and then the movable jaw and the adjusting member being moveably inserted within the mediate member;

wherein as the material making up the body is nonmetallic material, the nonmetallic material is selected from carbon fibers or glass fibers;

wherein the material making up the body is non-iron material, the non-iron material is selected from aluminum alloy or zinc alloy.

2. The method as claimed in claim 1, wherein the mediate member is made by way of powder metallurgy, precision casting or metal ejection.

3. The method as claimed in claim 1, wherein the adjusting member includes a worm member and a shaft extending through the worm member.

4. The method as claimed in claim 1, wherein the adjusting member includes a restriction member, a male part and a female part, the restriction member is sandwiched between the male part and the female part.

5. A method for making a wrench, comprising:

a step of formation: making a mediate member, a movable jaw and an adjusting member, which are made of metal;

a step of heat treatment: applying heat treatment to the mediate member, the movable jaw and the adjusting member to enhance rigidity;

a step of surface treatment: cleaning respective surfaces of the mediate member, the movable jaw and the adjusting member, coating an anti-rusting layer on the mediate member, the movable jaw and the adjusting member, and a step of combination: putting the mediate member in a mold and making a body which is made of nonmetallic material, the body integrally connected with the mediate member, the movable jaw and the adjusting member being moveably inserted within the mediate member;

wherein the nonmetallic material is selected from carbon fibers or glass fibers.

6. The method as claimed in claim 5, wherein the mediate member is made by way of powder metallurgy, precision casting or metal ejection.

7. The method as claimed in claim 5, wherein the adjusting member includes a worm member and a shaft extending through the worm member.

8. The method as claimed in claim 5, wherein the adjusting member includes a restriction member, a male part and a female part, the restriction member is sandwiched between the male part and the female part.

* * * * *